United States Patent [19]

Blum et al.

[11] 3,981,644

[45] Sept. 21, 1976

[54] SEALING STRIP PARTICULARLY FOR ROTARY ENGINES

[75] Inventors: Josef Blum, Mulheim (Ruhr); Heinz Lamm, Esslingen-St. Bernhardt; Alfred Sprang, Essen, all of Germany

[73] Assignees: Daimler-Benz Aktiengesellschaft, Stuttgart, Germany; Fried. Krupp Gesellschaft mit beschrankter Haftung, Essen, both of Germany

[22] Filed: Jan. 29, 1975

[21] Appl. No.: 545,293

[30] Foreign Application Priority Data

Feb. 1, 1974 Germany ..... 2404770

[52] U.S. Cl. ..... 418/122

[51] Int. Cl.[2] ..... F01C 19/02

[58] Field of Search ..... 418/113, 122—124, 418/249, 251, 266, 267

[56] References Cited

UNITED STATES PATENTS

| | | | |
|---|---|---|---|
| 3,180,564 | 4/1965 | Fuhrmann et al. | 418/122 |
| 3,263,913 | 8/1966 | Fuhrmann et al. | 418/113 |
| 3,270,954 | 9/1966 | Yamamoto | 418/113 |
| 3,716,313 | 2/1973 | Lamm | 418/122 |
| 3,885,898 | 5/1975 | Lamm | 418/122 |

FOREIGN PATENTS OR APPLICATIONS

| | | | |
|---|---|---|---|
| 1,159,224 | 12/1963 | Germany | 418/113 |
| 1,242,938 | 6/1967 | Germany | 418/122 |

*Primary Examiner*—C. J. Husar

*Attorney, Agent, or Firm*—Spencer & Kaye

[57] ABSTRACT

A sintered hard metal sealing strip particularly for constituting a radial seal in a rotary internal combustion engine, includes a hollow body with longitudinal ends each closed off by a sintered hard metal end face forming part of the hollow body.

3 Claims, 4 Drawing Figures

SEALING STRIP PARTICULARLY FOR ROTARY ENGINES

BACKGROUND OF THE INVENTION

This invention relates to a sealing strip, particularly for use as a radial seal for a rotary engine, for example, of the Wankel type and is usually held in an axially parallel groove provided in the face of the engine rotor. Such sealing strip in general serves to slidingly engage the combustion chamber wall to thus seal the chamber portions from one another. The sealing strip is, according to prior art structures, made of a sintered hard metal, and has a body with a longitudinally extending hollow space open at the longitudinal ends of the body. Alloys of the following composition may be used as sintered hard metal: WC - Co; WC - TiC - TaC - Co; TiC - Mo - Co; TiC - Mo - Ni; WC - TiC - Ni - Co.

Multi-part sealing strip structures are further known, wherein to the open ends of the hollow body there are attached solid extension parts.

There are further known sealing strips in which the openings at the ends of the strip are closed by a plug made of metal, ceramic or graphite.

Single-part and multi-part sealing strips of the above-outlined type which thus are made of a sintered hard metal and have a hollow body open at the end faces are disadvantageous in that they effect only an unsatisfactory seal, since pulsating hot combustion gases are present in the hollow space, leading to a deformation of the sealing strip and to a breaking-away of the lubricating film. The disadvantageous properties of the endwise open sealing strips manifest themselves in particular in an increased wear and a decreased engine output.

Although sealing strips provided with plugs as outlined above, have a closed hollow space, they have, because of the different extent of heat expansion of the different individual materials, very unfavorable wear properties.

SUMMARY OF THE INVENTION

It is an object of the invention to provide an improved, lightweight, wear resistant sealing strip made of sintered hard metal which may be a single-part or a multi-part member including a hollow body and from which the above-discussed disadvantages are eliminated.

This object and others to become apparent as the specification progresses, are accomplished by the invention, according to which, briefly stated, the hollow body is closed off by end faces made of a sintered hard metal.

By closing off the hollow space, an excessive heating of the sealing strip is avoided and by using a sintered hard metal, heat-caused stresses are not generated in the sealing strip. It is particularly advantageous if the hollow body of the sealing strip according to the invention is so designed that both end faces are rigidly affixed to the hollow body without transition, that is, the hollow body and the end faces together constitute an integral, one-piece member. By virtue of the fact that the hollow body forming part (or constituting) the sealing strip is, according to the invention, closed and unitary, there is achieved a good seal and a reduced wear. The durability of the sealing strip is, according to the invention, further enhanced by providing in the hollow body one or more bores that communicate with the hollow space. It is particularly advantageous to provide these bores in those faces of the hollow body which do not function as sealing faces.

The sealing strip designed according to the invention has, compared to the prior art structures, the advantage that while it has a reduced weight by virtue of the provision of the hollow space, it has a high degree of size stability, sealing performance and wear resistance.

DESCRIPTION OF THE PREFERRED EMBODIMENTS

Figure 1:
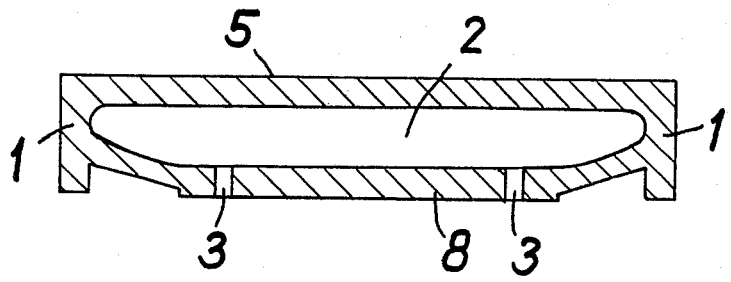
FIG. 1 is a longitudinal sectional view of a one-part hollow sealing strip according to a first preferred embodiment of the invention.

Turning now to FIG. 1, the single-part sealing strip shown therein is made of a sintered hard metal and has a hollow body 5, the hollow space 2 of which is closed at the two longitudinal ends of the body 5 by two faces 1 also made of sintered hard metal. The two faces 1 and the hollow body 5 consist of the same sintered hard metal. Alloys of the following composition may be used as sintered hard metal: WC - Co; WC - TiC - TaC - Co; TiC - Mo - Co; TiC - Mo - Ni; WC - TiC - Ni - Co. Particularly suitable is a sintered hard metal consisting of 88% by weight of WC and 12% by weight of Co.

The sealing strip has at its underside 8 two bores 3 which communicate with the hollow space 2.

Figure 2:
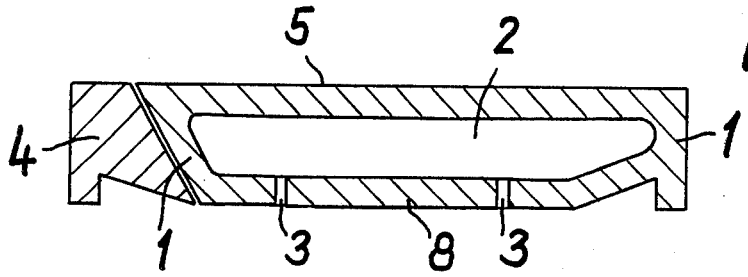
FIG. 2 is a longitudinal sectional view of a two-part sealing strip according to a second preferred embodiment.

In FIG. 2 there is shown a two-part sealing strip which is formed of a hollow body 5 and a solid extension part 4 which is attached to an oblique closing face 1 of the hollow body 5. The hollow body 5, similarly to the precedingly described embodiment, is closed at its longitudinal ends by faces 1 that are made of sintered hard metal and has at its underside 8 two bores 3 communicating with the hollow space 2.

Figure 3:
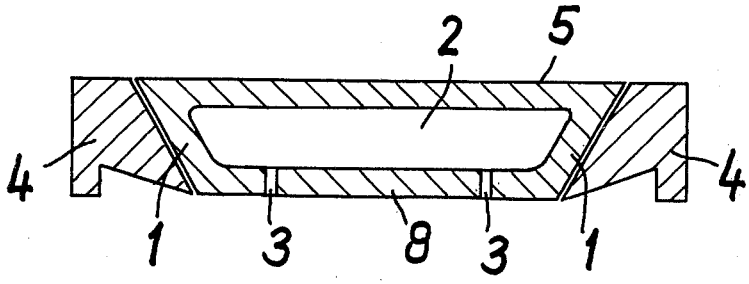
FIG. 3 is a longitudinal sectional view of a three-part sealing strip according to a third preferred embodiment.

In FIG. 3 there is illustrated a three-part sealing strip which includes a hollow body 5, to both oblique end faces 1 of which there are attached solid extension members 4. The hollow space 2 of the hollow body 5 is, at the longitudinal ends, closed off by the faces 1 which are made of a sintered hard metal. The underside 8 of the hollow body 5 is provided with two bores 3 which communicate with the hollow space 2. The solid extension members 4 and the end faces 1 consist of sintered hard metals of the same or different composition.

It is noted that in FIGS. 2 and 3 the components 4 are shown slightly separated from the hollow body 5 merely for the purpose of more clearly illustrating the plurality of parts.

Figure 4:
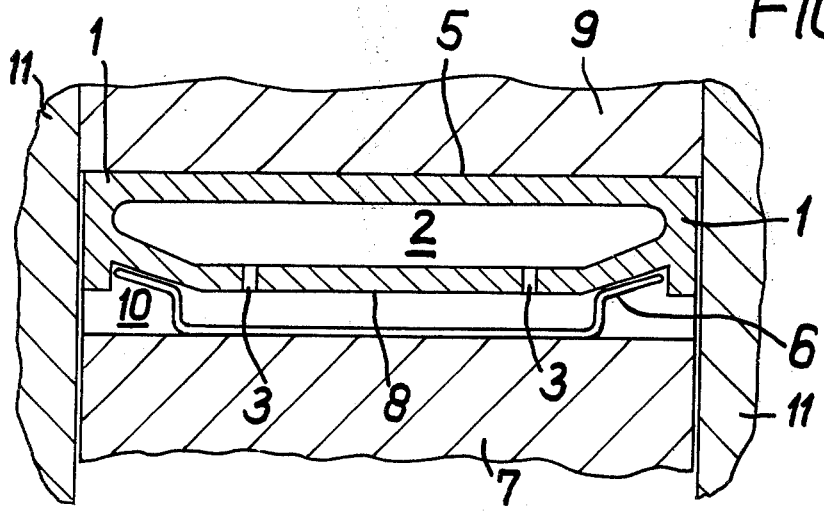
FIG. 4 is a fragmentary axial sectional view of a rotary engine incorporating the first preferred embodiment of the invention.

FIG. 4 shows a fragmentary section of a rotary engine taken in a plane that contains the rotary axis (not shown) of the engine and passes longitudinally through a radial seal constituted by a sealing strip which is designed according to the first embodiment described in connection with FIG. 1. The hollow body 5 constituting the sealing strip is accommodated in a groove 10 which is provided in the face of the engine rotor 7 and which extends parallel to the rotary axis of the rotor 7.

The hollow body 5 is urged by a spring 6 into sealing engagement with the inner wall of the housing 9 which, together with closure plate components 11, define the combustion chamber of the rotary engine.

It will be understood that the above description of the present invention is susceptible to various modifications, changes and adaptations, and the same are intended to be comprehended within the meaning and range of equivalents of the appended claims.

We claim:

1. A sintered hard metal sealing strip particularly for constituting a radial seal in a rotary internal combustion engine, the sealing strip including a body having a cavity extending longitudinally within the body and two longitudinal ends, the improvement comprising sintered hard metal end faces forming part of said body and closing off said cavity; both said ends being connected with the respective end face fixedly without transition.

2. A sealing strip as defined in claim 1, including at least one solid extension component attached to at least one of said end faces.

3. A sealing strip as defined in claim 1, wherein said body has an effective sealing face; further including means in said body defining at least one throughgoing bore in communication with said cavity and contained in a face of said body other than said effective sealing face.

* * * * *